US005115885A

United States Patent [19]

Chouest

[11] Patent Number: 5,115,885

[45] Date of Patent: May 26, 1992

[54] FIRE ESCAPE DEVICE

[76] Inventor: Evans J. Chouest, P.O. Box 123, Cut Off, La. 70345

[21] Appl. No.: 754,619

[22] Filed: Sep. 4, 1991

[51] Int. Cl.[5] ..... A62B 1/20

[52] U.S. Cl. ..... 182/3; 182/82; 182/48

[58] Field of Search ..... 182/3-8, 182/9, 36, 82, 48

[56] References Cited

U.S. PATENT DOCUMENTS

| | | | |
|---|---|---|---|
| 802,252 | 10/1905 | Anderson | 182/3 |
| 3,944,021 | 3/1976 | Smith | 182/3 |
| 4,125,172 | 11/1978 | Hatala | 182/3 |
| 4,207,965 | 6/1980 | Cheng | 182/3 |
| 4,222,140 | 9/1980 | Olewinski | 182/36 |
| 4,295,543 | 10/1981 | Graham | 182/3 |
| 4,466,507 | 8/1984 | Itano | 182/3 |
| 4,499,966 | 2/1985 | Milne | 182/3 |
| 4,520,895 | 6/1985 | Armstrong | 182/3 |
| 4,709,782 | 12/1987 | Lipinski | 182/3 |

*Primary Examiner*—Reinaldo P. Machado
*Attorney, Agent, or Firm*—Fleit, Jacobson, Cohn, Price, Holman & Stern

[57] ABSTRACT

A fire escape device incorporated into new buildings or added on to existing buildings by which occupants of the building may quickly and safely exit from the building in the case of fire or other emergency conditions. The fire escape device includes a vertical track or guide that slidably receives a slide in the form of a backpack attached to each person using the fire escape device. The slide or backpack includes an oscillatable control member that swings back and forth about an axis perpendicular to the track or guide and engages a plurality of stationary pins oriented in staggered spaced relation on opposite side of the guide or track and control members that control the speed of descent of the slide or backpack and the individual supported thereon. An interlock device is provided to control access to the track or guide to insure proper sequential use of this fire escape device by a plurality of individuals. The lower end of the fire escape device includes an angulated discharge chute or ramp or transversely aligned control pins to stop the slide or backpack just prior to reaching a bottom support surface to enable a person to safely use the fire escape device. The arrangement of the components also will stop succeeding users until the lower most user has exited from the fire escape device.

12 Claims, 2 Drawing Sheets

FIRE ESCAPE DEVICE

BACKGROUND OF THE INVENTION

1. Field of the Invention

A fire escape device incorporated into new buildings or added to existing buildings by which occupants of the building may quickly and safely exit from the building in the case of fire or other emergency conditions. The fire escape device includes a vertical track or guide that slidably receives a slide in the form of a backpack attached to each person using the fire escape device. The slide or backpack includes an oscillatable control member that swings back and forth about an axis perpendicular to the track or guide and engages a plurality of projecting stationary pins oriented in staggered spaced relation on opposite side of the guide or track and control members that control the speed of descent of the slide or backpack and the individual supported thereon. An interlock device is provided to control access to the track or guide to insure proper sequential use of the fire escape device by a plurality of individuals. The lower end of the fire escape device includes an angulated discharge chute or ramp to enable the slide and occupant to exit from the track or transversly aligned control pins to stop the slide or backpack just prior to reaching a bottom support surface to enable a person to safely use the fire escape device. The control members also stop succeeding users until the lower most user has exited from the fire escape device.

2. Description of the Prior Art

Various types of fire escape devices have been provided in building structures inasmuch as various local building codes require that fire escape capabilities be incoporated into buildings. The following U.S. patents relate to this field of endeavor.

U.S. Pat. No. 802,252
U.S. Pat. No. 4,125,172
U.S. Pat. No. 4,207,965
U.S. Pat. No. 4,222,140
U.S. Pat. No. 4,295,543

While the structures disclosed in the above patents are relevant to this invention, the prior patents do not disclose the specific structure of the track, slide, descent control pins and spring biased control members and the interlock to control access to the track by the individual users.

SUMMARY OF THE INVENTION

An object of the present invention is to provide a fire escape device by which a plurality of individuals can quickly and safely exit from an elevated position in a building by movement down a vertically disposed track or guide with the rate of descent being automatically controlled.

Another object of the invention is to provide a fire escape device in accordance with the preceding object in which each individual user is provided with a slide or backpack which is connected to the individual using the device by a seat and strap arrangement with the elevated upper end of the track or guide including an entrance structure which enables sequential access to the track or guide by a plurality of users thereby assuring that only a single user has access to the upper end of the track or guide at any one time.

A further object of the invention is to provide a fire escape device in accordance with the preceding objects in which the track or guide includes rigid, stationary projecting pins oriented in staggered spaced relation on each side of the track or guide to engage an oscillating member mounted on the slide or backpack with the oscillating members sequentially engaging the pins on the opposite side of the track or guide during descent to control the rate of descent.

Still another object of the invention is to provide a fire escape device in accordance with the preceding objects in which the slides or backpacks are controlled during their descent by pivotally mounted spring biased control members which also maintain sequential slides or backpacks in spaced relation during their descent thereby maintaining a spaced relation between the individuals descending in the fire escape device.

A still further object of the invention is to provide a fire escape device in accordance with the preceding objects in which the lower end of the fire escape device is provided with an outwardly inclined chute which enables the users to exit the device in a rapid manner or alternatively, a pair of transversely aligned pins are provided to stop the slide at the lower end of the fire escape device to enable the individuals to exit from the fire escape device.

These together with other objects and advantages which will become subsequently apparent reside in the details of construction and operation as more fully hereinafter described and claimed, reference being had to the accompanying drawings forming a part hereof, wherein like numerals refer to like parts through-out.

DESCRIPTION OF THE PREFERRED EMBODIMENT

Figure 1:
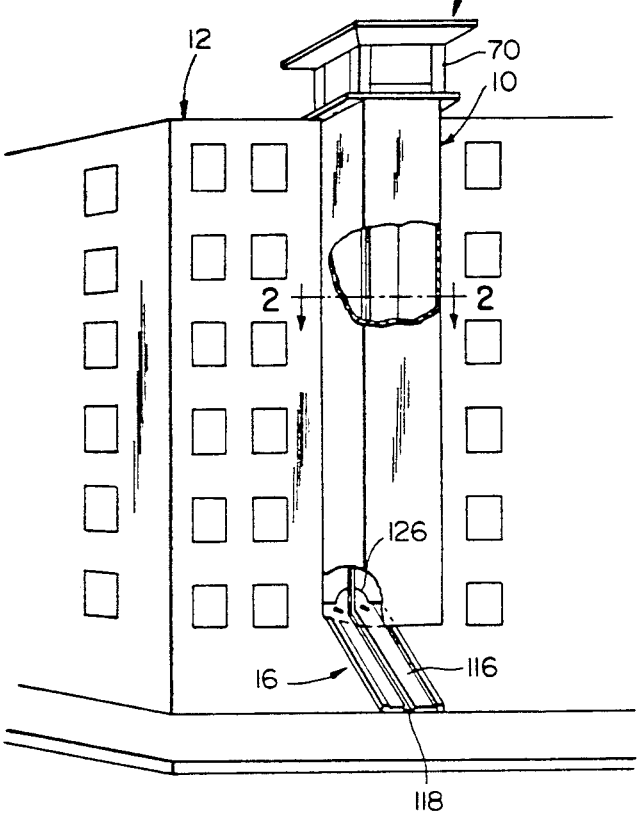
FIG. 1 is a perspective view of the fire escape device of the present invention incorporated into a multi-story building.
Figure 7:
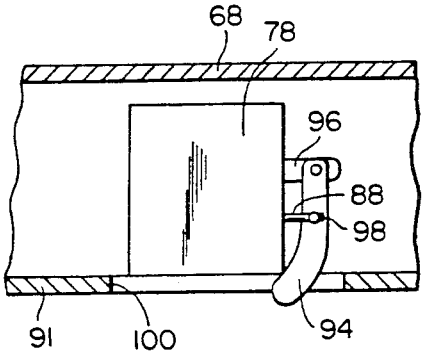
FIG. 7 is a further detailed view of the access structure of FIG. 4.

Referring now specifically to the drawings, the fire escape device of the present invention is generally designated by the reference numeral 10 and, in FIG. 1, is illustrated along the exterior surface of a multi-story building 12. It is pointed out that the fire escape device 10 can be incorporated interiorally of the peripheral wall of the building with the upper end of the fire escape device 10 including an entrance access area generally designated by reference numeral 14 and the lower end thereof being provided with an exit area 16.

The fire escape device 10 includes a track or guide structure generally designated by the numeral 18 and a plurality of slides or backpacks generally designated by reference numeral 20 with each individual user having a slide or backpack 20 attached in a manner described hereinafter with the slide or backpack 20 and the user supported thereby descending along the track or guide 18 from the access area 14 to the exit area 16 in a manner described hereinafter.

Figure 2:
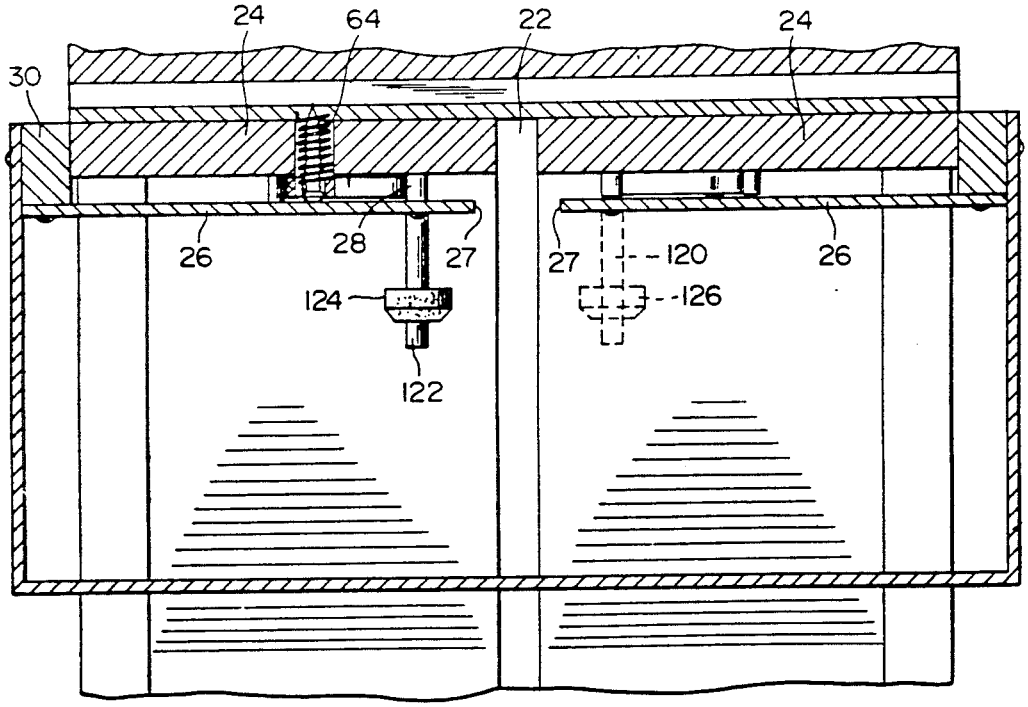
FIG. 2 is a transverse, vertical sectional view taken substantially upon a plane passing along section line 2—2 on FIG. 1 illustrating the specific construction of the track or guide.
Figure 3:
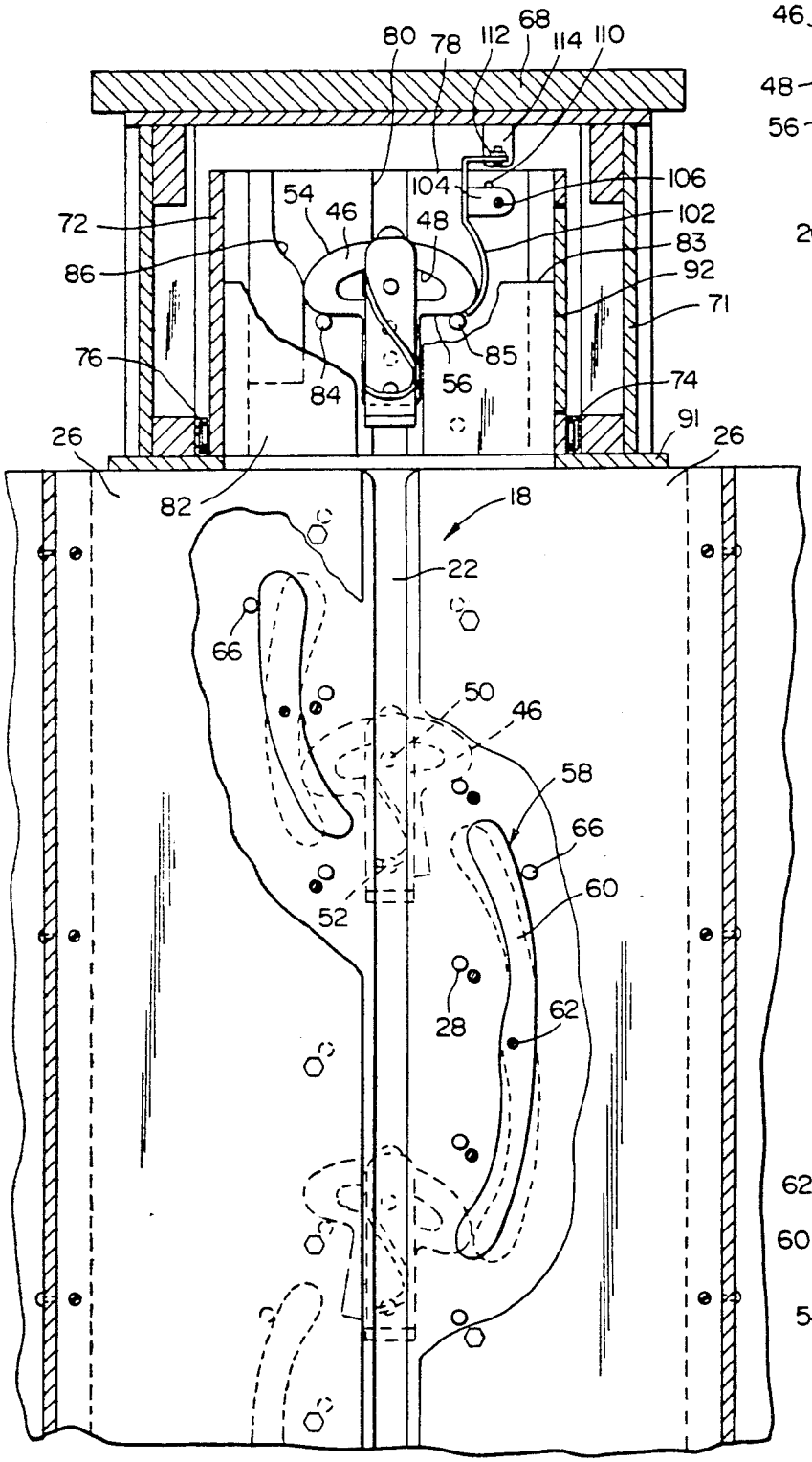
FIG. 3 is an enlarged detailed view illustrating the upper end of the track or guide and the structure providing access to the upper end of the track or guide.
Figure 5:
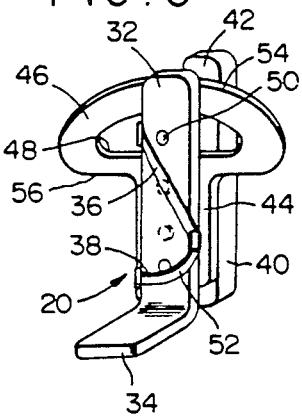
FIG. 5 is a perspective view of the slide or backpack used by each individual.

The track or guide 18 includes a vertically elongated groove 22 which may be defined by a pair of spaced side panels 24. Attached to the panels 24 in spaced parallel relation thereto is a pair of front panels or plates 26 which are supported in spaced relation by a plurality of pins 28 and brackets 30 at the outer edges thereof with the pins 28 being arranged in vertical rows on each side of the groove 22 with the pins being equally spaced from the groove 22 and equally spaced from each other but the pins on one side are staggered in relation to the pins on the other as illustrated in FIGS. 2 and 3. Suitable fasteners are used to secure the panels 24 and panels or plates 26 in spaced relation and to secure the fire escape device to the building wall 12.

The slide or backpack 20 includes a vertical member 32 extending along the back surface of a user and a horizontal member 34 at the lower end of the vertical member which extends outwardly and forms a seat to support an individual user. Shoulder straps 36 and waist straps 38 are used to secure the slide or backpack to the individual user with the vertical member and seat member enabling the user to walk to the access area and walk away from the exit area. Rigidly attached to the member 32 is a guide member 40 which is elongated and provided with rounded ends 42 for sliding and guiding engagement with the groove 22. Intermediate the guide member 40 and the vertical back engaging member 32 is an oscillating member 44 of generally T-shaped configuration having a laterally enlarged upper end portion 46 provided with an enlarged opening 48 extending therethrough to define the limits of pivotal movement of the oscillating member 44 with a pin or fastener 50 extending through the opening 48 from the member 32 into the member 40 thereby limiting the pivotal movement of the oscillating member about a pivot fastener 52. The upper end edge of the enlarged upper end 46 is arcuately curved at 54 and the lower edge thereof includes generally straight downwardly facing surfaces 56 which engage with the pins 28 as illustrated in FIG. 3. As the slide or backpack 20 descends down the track or guide 18, the oscillatable member 46 will swing back and forth between the panels 24 and front panels 26 and engage pins 28 on the opposite side of the groove 22. This structure and function controls the descent of the slide or backpack 20. The vertical member 32 is positioned between the spaced inner edges 27 of the front panels 26.

Figure 6:
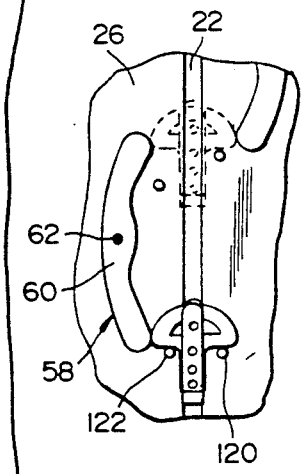
FIG. 6 is a detailed elevational view of the pins, control members and slide.

A plurality of descent control members 58 are mounted on the panels 24 and are positioned between the panels 24 and the front panels 26. Each descent control member 58 includes an elongated generally arcuate member 60 pivotally mounted on a pin 62 at the center thereof with an axial spring 64 surrounding the pin 62 with one end anchored to the panel 24 and the other end anchored to the member 60 to bias the lower end of the elongated, generally arcuately curved member 60 inwardly toward the groove 22 for engaging the outer edge portions of the oscillating member 46 which moves the elongated member 60 from the full line position to the broken line position against the resistance of spring 64. Each of the pivotal members 60 engages a pin 66 above the pivot pin 62 with the pin 66 engaging the outer upper surface area of each member 60 to retain them in a normal position illustrated in solid line in FIG. 3. Thus, the member 60 further controls the descent of the slide or backpack 20 and also prevents the descending backpacks from coming into contact with each other since the oscillating member 40 on a lower slide or backpack 20 must release the lower end of the member 60 before the upper end of the member 60 permits oscillating movement of the oscillating member 46 from its generally neutral position to a position to release from the pin 28 which engages the surface 56 of the oscillating member 46 as illustrated in FIG. 6.

The access area 14 includes a roof structure 68 and a wall structure 70 to protect the access area from inclement weather and the like and to provide access to a horizontally movable enclosure 72 having rollers 74 at the lower end thereof engaged in tracks 76 supported from the walls 70 to enable the enclosure 72 to move from a position in alignment with the track or guide 18 and a position misaligned with respect thereto. One wall 78 of the enclosure 72 includes a groove 80 which aligns with the groove 22 and panels 82 which align with the panels 26. The groove 80 has pins 84 associated therewith in the same manner as the pins 28 are associated with groove 22 and a guide structure 86 is provided on one side of the groove 80 and a removable pin 88 is provided on the opposite side of the groove 80 in alignment with the upper most pin 84 as illustrated in FIG. 3 thus supporting the downwardly facing surfaces 56 on opposite ends of the oscillating member 46 thus preventing downward movement of the slide or backpack from the groove 80 into the groove 22 until the pin 88 has been removed.

The enclosure 72 is provided with a loop handle 90 by which it can be moved between positions with the groove 80 in alignment with the groove 22 and a position in which the groove 80 and open bottom area of the enclosure are aligned with a bottom surface 91 of the access area 14. A pivotal door 92 is provided in the wall of the enclosure to provide access into the interior of the enclosure. The access door 92 in the enclosure is concealed behind a short wall 71 thus preventing entrance to the enclosure when the groove 80 is aligned with the groove 22. When the enclosure 72 is moved to a position with the groove 80 out of alignment with the groove 22 and the open bottom of the enclosure is aligned with the solid portion of the bottom wall 91, the door 92 is accessible and can be pivoted to an open position to enable a person with a slide or backpack attached to enter the enclosure 72. While the enclosure 72 is in this position, the person positions the member 40 in the groove 80 and the oscillatable member 46 over top of the upper edge 83 of the panels 82 to be positioned in engagement with the pins 84 and 88. After the backpack with the individual attached thereto is positioned for engagement of the member 40 with the groove 80 and the oscillating member 46 engaging the upper most pin 84 and the retractable pin 88, the enclosure 72 then may be manually moved to align the groove 80 with the groove 22. When this occurs, the retractable pin 88 which extends through a wall 78 of the enclosure is retracted by an actuator 94 pivotally supported from a bracket 96 and pivoted to the outer end of the pin 88 by a pivotal and sliding connection 98. The lower end of the actuator 94 extends below the lower end of the wall 78 and into a slot 100 in the bottom wall 91 so that when the curved lower end of the actuator 94 engages the end of the slot 100, the pin 88 will be retracted to enable the oscillatable member 46 to pivot and swing about pivot pin 52 as it pivots and slides off the uppermost pin 84 as illustrated in FIG. 3.

Figure 4:
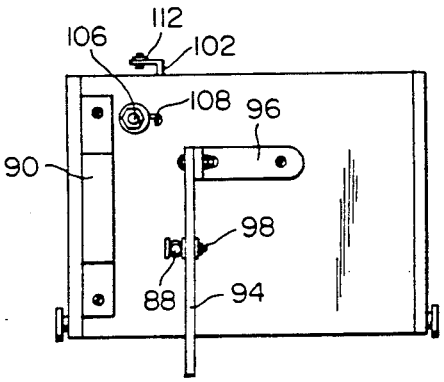
FIG. 4 is a detailed view of the access structure for the upper end of the track or guide.

A curved member 102 is pivoted to the wall 78 by a bracket 104 mounted on pin or fastener 106 with an axial coil spring 108 biasing the pin 106, bracket 104 and curved member 102 toward the groove 80 and into contact with the oscillatable member 46 as illustrated in FIGS. 3 and 4. A stop pin 110 mounted on wall 78 limits movement of curved member 102. The upper end of the member 102 includes a roller 112 mounted thereon which engages a member 114 mounted on the roof 68 of the access area 14 which retracts the curved member 102. Thus, the member 102 also serves to hold the oscillating member 46 in its position in engagement with the upper most pin 84 until the roller 112 engages the member 114 which moves the member 102 away from engagement with the oscillating member 46.

The exit end 16 of the fire escape device includes an inclined chute 116 having a groove 118 therein forming a continuation of the groove 22 to enable the slide or backpack and the occupant thereof to be discharged by gravity in a downwardly and outwardly inclined relation so that the feet of the person occupying the slide can engage a ground surface or the like and walk away from the fire escape device.

In some installations, the use of an inclined chute may not be possible in which event a stop pin 120 is inserted in the panel 24 in transverse alignment with a lowermost pin 122 in opposed alignment therewith with the pins 120 and 122 extending outwardly and provided with resilient retainers 124 thereon. The lower end of the panels 26 are cut away at 126 to enable the occupant of the slide to be stopped by the lowermost pins 120 and 122 and then move the slide outwardly and lift the oscillating member 46 upwardly over the retainers 124 and exit from the fire escape device.

Each individual in the building will have a slide or backpack available and for compactness of storage the seat 34 may fold upwardly. When the building is to be evacuated under emergency conditions such as when a fire occurs, each individual will use shoulder straps and waist straps to secure the slide to themselves and walk to the access area. The individuals using the access area can enter the enclosure 72 one at a time when the door 92 is exposed from the short wall 71 of the access area. In this position, the open bottom of the enclosure 72 is aligned with a solid portion of the floor 91 which enables the person entering the enclosure 72 to engage the member 40 in the groove 80 and the oscillating member 46 behind the panels 82 and in engagement with the guide 86, upper most pin 84, retractable pin 88 and spring biased member 102. The enclosure 72 is then moved by use of the handle 90 or any other means to a position with the groove 80 in alignment with the groove 22 and the open bottom of the enclosure 72 in alignment with the area forwardly of the panels 26. As this occurs, the actuator 94 engages the forward end of the slot 100 thus retracting the pin 88 and the roller 112 engages stop member 114 to retract curved member 102 away from oscillatable member 46 thus enabling the oscillating member 46 to pivot about pin 52 away from the uppermost pin 84 and thus enabling the slide to move downwardly from groove 80 into groove 22 with the oscillating member 46 sequentially engaging the pins 84 and then the pins 28 as well as the retarding members 60 to control the descent of the slide and the occupant. At the lower end of the fire escape, the slide will automatically move on to the inclined chute 116 or in the event the chute is not used, the slide will be stopped by the lowermost pins 120 and 122 and the occupant then can exit the fire escape by moving the slide and the oscillating member 46 through the cutaway lower ends 126 of the panels 26. When the oscillating member 46 engages the two lowermost pins 120 and 122, the next slide cannot come into contact with the stopped slide since the stopped slide will engage the lower end of the lowermost member 60 thus holding the upper end thereof in alignment with the lower surface 56 of the oscillating member 46 thus holding the oscillating member 46 in horizontal position and preventing it from continuing its downward movement until the lower end of the member 60 is disengaged by the slide thus enabling the camming action of the oscillating member 46 to move the upper end of the member 60 back to its solid line position against the pin 66 thus enabling the oscillating member to proceed downwardly. This arrangement prevents upper slides from coming into contact with lower slides and prevents occupants of upper slides from coming into contact with occupants of lower slides. Thus, a safe and quick sequential exit from the roof or other area of the building is provided.

In addition to being used as a fire escape, the structure of the present invention may be constructed on a smaller scale and used as a toy in which a miniature figurine can be secured to the reduced size slide 20. The slide 20 with the figurine thereon can be placed in the upper end of the track 18 and descend to the lower end of the track in the same manner as when the device is full size and used as a fire escape. When used as a toy the entrance structure at the upper end of the track can be omitted with the slide 20 merely being manually placed in the open upper end of the track 18 for movement downwardly to and out of the exit are 16.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A fire escape device comprising a generally vertically disposed track supported in a building and extending from an elevated area of the building to a lower egress area, a slide mounted on an individual user of a fire escape device, said slide and track including coacting means enabling the slide to be assembled in relation to the track at the elevated position in the building and guiding and controlling the descent of the slide as it moves from the elevated position to the egress position, said means controlling descent of the slide including a plurality of vertically spaced pins positioned along each side of the track with the pins on one side being staggered in relation to the other, said slide including an oscillatable member having downwardly facing lower surface areas engagable with and sliding off alternate pins on opposite sides of the track during descent of the slide, said egress position of the track including means enabling the slide and occupant of the slide to separate from the track.

2. The fire escape device as defined in claim 1 wherein said means controlling the descent of the slide also including a plurality of spring biased, elongated control members, means mounting the central portion of the control members for pivotal movement of the upper and lower ends of the control members toward and away from the track, said control members being spring biased with the lower ends thereof biased towards the track and into the path of movement of the oscillatable member on the slide to cause outward movement of the lower end of the control member and inward movement of the upper end of the control member in relation to the track to prevent a subsequent slide from progressing downwardly in the track until the next lower slide has passed the lower end of the control member.

3. The fire escape device as defined in claim 2 wherein said track includes a longitudinal groove, said slide including a vertically extending rearward projection slidable in the groove, a pair of panels oriented with their adjacent edges in spaced relation to each other and to the edges of the groove, said oscillatable member being positioned inwardly of the panels to prevent lateral outward movement of the slide in relation to the track during descent, the lower ends of the panels being relieved to enable removal of the slides from the track at the egress position.

4. The fire escape device as defined in claim 3 wherein said egress position includes a pair of transversely aligned pins to stop the lowermost slide while the oscillatable member is in engagement with the lower end of the lowest control member thereby stopping all of the slides until the lowermost slide has been removed from the track.

5. The fire escape device as defined in claim 3 wherein said egress position includes an outwardly inclined chute having a continuation of the groove for guiding slides downwardly and outwardly in relation to the track.

6. The fire escape device as defined in claim 3 wherein said elevated position of the track includes means enabling access of a single slide and occupant to the upper end of the track.

7. The fire escape device as defined in claim 6 wherein said means enabling access of only one slide and occupant to the upper end of the track including a movable enclosure having an access door with the movable enclosure moving from a position in alignment with the track to a position laterally displaced therefrom, said enclosure including a vertical wall having a groove therein for selective alignment with the groove forming the track, means enabling insertion of the slide into the groove but preventing downward movement thereof while the groove in the wall is misaligned in relation to the track and automatically releasing the slide when the groove in the wall aligns with the track.

8. The fire escape device as defined in claim 7 wherein said means preventing downward movement of the slide includes a retractable pin engaging the slide to prevent its downward movement until the pin is retracted.

9. The fire escape device as defined in claim 8 wherein said retractable pin is mounted on the movable wall, and actuator means connected to the retractable pin and engageable with the stationary component of the fire escape device to retract the pin when the wall and groove therein are moved into alignment with the track.

10. The fire escape device as defined in claim 3 wherein said slide includes a vertical member and a relatively short horizontal member forming a seat and backrest for an occupant.

11. The fire escape device as defined in claim 3 wherein said oscillatable member includes a transversely enlarged upper end portion having a downwardly facing surface thereon with the upper end portion bridging the track and the inner edges of the panels to retain the slide assembled with the track during downward movement from the elevated position to the egress position.

12. An apparatus for lowering an entity from an elevated position to a lower position by using the force of gravity, said apparatus comprising an elongated, vertically disposed track having an open upper end and an exit area at its lower end, a slide having an entity mounted thereon, said slide being positionable in the upper end of said track for descent toward the lower end, said slide and track including coacting means guiding and controlling the descent of the slide from the upper end of the track toward a lower end thereof, said coacting means including a plurality of vertically and horizontally spaced pins projecting outwardly on each side of said track, and an oscillatable member mounted on said slide for sequentially engaging the pins on opposite sides of the track for controlling the rate of descent of the slide, and a plurality of spring biased control members associated with the pins and oscillatable member and being mounted on the track to control the movement of sequential slides.

* * * * *